United States Patent [19]

Saintsbury

[11] 3,952,501

[45] Apr. 27, 1976

[54] GAS TURBINE CONTROL

[75] Inventor: John A. Saintsbury, St. Bruno, Canada

[73] Assignee: United Aircraft of Canada Limited, Longueuil, Canada

[22] Filed: Jan. 2, 1974

[21] Appl. No.: 429,946

Related U.S. Application Data

[63] Continuation-in-part of Ser. No. 244,134, April 14, 1972, abandoned.

[30] Foreign Application Priority Data

Apr. 15, 1971 United Kingdom ..... 9530/71

[52] U.S. Cl. ..... 60/39.23; 60/39.65; 60/DIG. 11

[51] Int. Cl.[2] ..... F02C 9/14

[58] Field of Search ..... 60/39.23, 39.27, 39.29, 60/39.65, DIG. 11

[56] References Cited

UNITED STATES PATENTS

| | | | |
|---|---|---|---|
| 2,446,059 | 7/1948 | Peterson | 60/39.23 UX |
| 3,731,484 | 5/1973 | Jackson | 60/39.23 |
| 3,765,171 | 10/1973 | Hagen | 60/39.23 |

*Primary Examiner*—Clarence R. Gordon
*Attorney, Agent, or Firm*—A. W. Breiner

[57] ABSTRACT

A continuous combustion device of the type having a combustion chamber and an outer casing forming with it an annular air delivery passage for distributing a continuous supply of compressed air into the combustion chamber, and a fuel injector at one end of the combustion chamber. The combustion chamber has a pattern of holes connecting the air passage with primary and secondary combustion zones within it. The invention provides adjustable means for controlling the flow of delivery air in the annular passage to proportion the relative air distribution to the primary and secondary zones so as to reduce polluting emissions under varying load conditions. Preferably, the hole pattern is designed to provide a lean primary zone fuel-air ratio at full power conditions and early quenching of the flame in the primary zone. The regulating device may take the form of adjustable baffle means and for proportioning the distribution of the flow of air in the annular passage.

11 Claims, 7 Drawing Figures

GAS TURBINE CONTROL

CROSS-REFERENCE TO RELATED APPLICATION

This application is a continuation-in-part of U.S. application Ser. No. 244,134, filed Apr. 14, 1972 now abandoned.

BACKGROUND OF THE INVENTION

1. Field of the Invention

This invention relates to gas turbines.

More particularly, the invention relates to gas turbines equipped to operate in such a manner as to reduce air pollution.

2. Description of the Prior Art

Ideally, from a combustion or pollution aspect or both, the primary or combustion zone fuel-air ratio should be kept as close as possible to an optimum value, which may be constant over the operating range of a gas turbine. This does not normally happen, since the fixed geometry of the conventional combustor provides a range of primary or combustion zone fuel-air ratios, which can go from over-rich to over-lean.

The constituent emissions from a gas turbine exhaust are formed by diverse processes, dependent on a number of local environmental conditions. The formation of nitric oxides, for example, depend on conditions opposed to those forming carbon monoxide or hydrocarbons. Particulate emissions are dependent on yet another environment. These opposed conditions complicate the designing of a combustor to achieve optimum results.

Attempts to compensate for the extremes of local environment experienced in the cycling of a gas turbine give rise to problems. For example, since nitric oxide formation rate depends essentially on the temperature in the reaction zone and the availability of dissociated or free oxygen, its formation can be related to the residence time of the reactants in the primary or combustion zone, or, to the length of the fluid flow path within the burner, from the fuel nozzle to the dilution zone. An early or accelerated admission of cooling or dilution air can quench the reaction and restrict nitric oxide formation to low levels. This procedure may, however, increase hydrocarbons, smoke and carbon monoxide formation due to incomplete combustion. The residence time of the combustion gases in the primary zone, due to recirculation, may also have a significant effect on nitric oxide emission, due to the high associated temperatures.

In a normal combustor, at full load, carbon monoxide and hydrocarbons are practically non-existent, whereas nitric oxide emission is at its peak. A combustor optimized for full load pollutant emissions would have a leaner than normal primary zone fuel-air ratio, its yield in hydrocarbons and carbon monoxide would be higher, whereas nitric oxides would be considerably reduced. Such a combustor would not be practical for a normal application where the fuel-air ratio is varied over a wide range, especially its stability would be poor and at idle, the hydrocarbons and carbon monoxide emissions would be very high.

SUMMARY OF THE INVENTION

The applicant has now found that air pollution from gas turbines can be greatly reduced by varying the primary or combustion zone fuel-air ratio and as a result the secondary or dilution zone fuel-air ratio, under varying load conditions.

The invention provides for regulating the primary or combustion zone fuel-air ratio to be optimized for pollutants and efficiency, by effecting a substantially optimum proportionate distribution of combustion air throughout the combustor at all power levels. The fraction of primary zone air flow will be gradually reduced as the power is decreased, holding the fuel-air ratio substantially to the predetermined optimum value, as compared to a fixed geometry combustor, in which the primary zone normally leans out rapidly as power is reduced.

This procedure reduces the production of carbon monoxide and unburnt hydrocarbons at low power, because combustion takes place at a more favourable fuel-air ratio. The nitric oxide production is inherently low at reduced power, because of the lower temperature of inlet air to the combustor.

In the applicant's starting regime, regulation is such that most of the air fed to the combustor is directed so that it does not reach the primary combustion zone. The result is that a richer, easier to ignite fuel-air mixture is provided in the primary zone which burns relatively hotter, and thus the burnt gases have a lower carbon monoxide and hydrocarbon content. As the fuel flow is increased, the air flow may be proportionally adjusted to increase the proportion of air flowing into the primary zone. In a similar manner, combustion stability is assured on deceleration from high power conditions due to the regulated increase in fuel-air ratio.

A typical continuous combustion power plant according to the invention can be made up of an outer casing and a combustion chamber disposed within the casing and forming between the tube and casing an annular air passage. The combustion chamber has a plurality of holes defined thereon connecting the air passage with primary and secondary combustion zones within the chamber. There is means forming a delivery air inlet communicating with the air passage, a fuel injector at one end of the combustion chamber at the primary zone, and means for igniting the injected fuel-air mixture. According to the invention, there is provided adjustable means for controlling the flow of air in the passage to proportion the relative air distribution from it to the respective primary and secondary zones. This adjustable means can be in the form of baffle means. The baffle means may, for example, be activated by compressor delivery air pressure or by hydraulic or mechanical or other suitable linkage to the fuel or engine controls. The holes in the burner tube are preferably arranged in a pattern, providing inherently for minimum emission of oxides of nitrogen at high power operation by means of reducing primary combustion zone temperatures.

The invention is applicable to different kinds of combustors, for example, straight through annular, reverse flow annular, can type, or can annular type. Different kinds of fuel injection systems may be employed, for example, air atomizing or vaporizing, or pressure atomizing fuel injectors.

BRIEF DESCRIPTION OF THE DRAWINGS

Having thus generally described the invention, it will be referred to more specifically by reference to the accompanying drawings, illustrating preferred embodiments, and in which.

DESCRIPTION OF THE PREFERRED EMBODIMENTS

Figure 1:
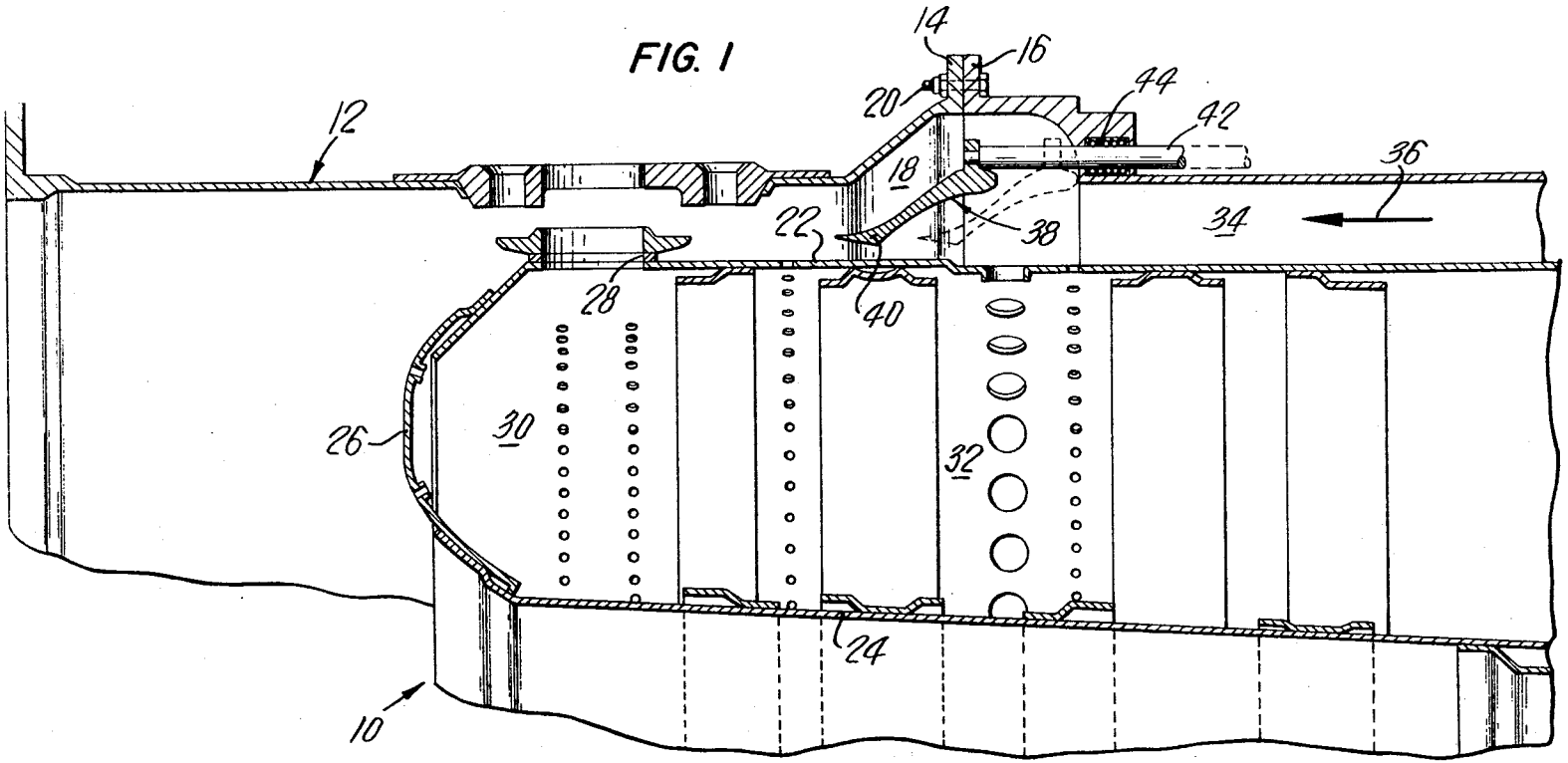
FIG. 1 is a fragmentary radial cross-section taken through a typical annular type combustion chamber.
Figure 2:
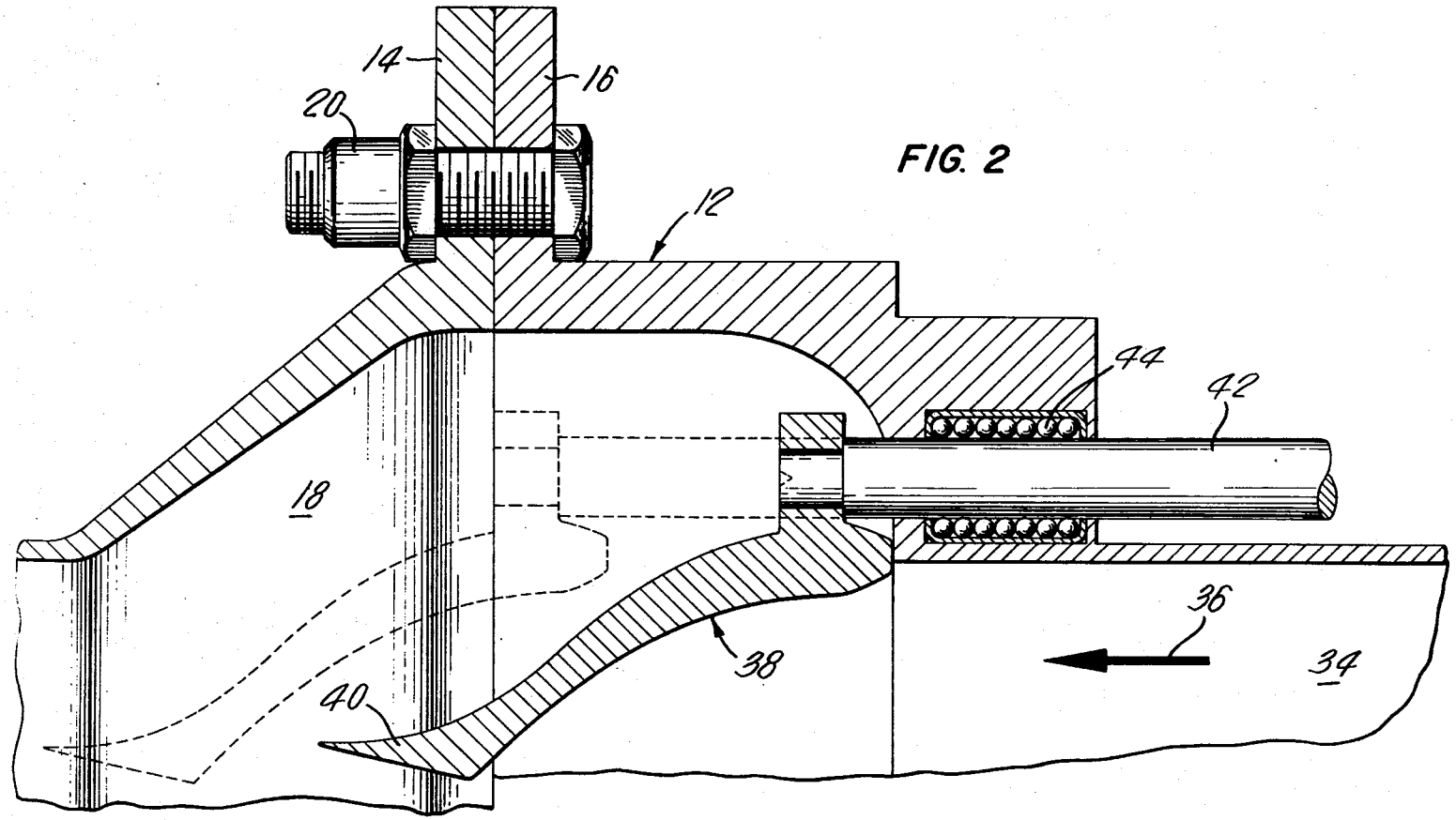
FIG. 2 is an enlarged fragmentary view of a detail shown in FIG. 1.

Referring now to the drawings, especially to FIGS. 1 and 2, there is shown a reverse flow annular type of combustion chamber 10 extending concentrically with an outer cylindrical engine casing 12.

The outer casing 12 is split and joined at flanges 14 and 16. An annular recess portion 18 is provided at the flange joint of the casing.

The combustion chamber 10 includes concentric outer and inner walls 22 and 24 respectively. The combustion chamber terminates at one end in a curved end wall 26. A plurality of holes 25 are provided in the section of the combustion chamber near the end wall 26 which form the primary combustion zone 30. An aperture 28 is provided on the outer wall 22 for receiving a fuel burner nozzle (not shown). Adjacent the primary zone 30, a secondary zone can be defined, and a plurality of apertures 27 may be provided as well as enlarged apertures 29. The apertures 29 allow for greater volume of cooling air to enter into the secondary zone.

An annular air passage 34 is formed between the casing wall 12 and the outer wall 22 of the combustion chamber 10. The air entering into this area follows the direction of the arrow 36 and passes longitudinally through the annular passage 34.

The annular recess 18 in the casing 12 is located substantially between the so-called primary and secondary combustion zones 30 and 32 in the combustion chamber 10. An annular baffle 38 is provided in the recess and extends downwardly in the air passage as shown. The baffle is shaped to have certain airfoil characteristics and has a hammerhead shaped tip 40 which induces a better lamination of the air flow as it leaves the baffle 38. The annular baffle 38 is mounted to a series of sliding control rods 42 which in turn slide in a bearing case 44 provided in the casing 12 body.

Baffle 38 can be moved between a position shown in full lines, that is, midway relative to the recess 18, and to a position shown in dotted lines, that is, to the extreme right of the recess 18, as shown in the drawings. When the baffle 38 is in the position shown in full lines, that is, midway of the recess 18, the air flow, following the direction of the arrow 36, is allowed to pass relatively unimpeded through the air passage 34 by passing on both sides of the baffle 38. This general flow of air will reach both the secondary zone and the primary combustion zone practically as if no baffle existed and as in conventional engines of this type.

Thus, if the air-fuel ratio is normally set for load conditions, the baffle 38 is maintained in this position. If the aircraft is on the ground and the engine is idling, such an air-fuel ratio would be unsuitable since the emissions of hydrocarbons and carbon monoxide would be too high. Accordingly, it has been found that it would be best to have a richer mixture in the primary zone, therefore creating a hotter burn in this primary zone and to divert more cooling air into the secondary zone whereby the hot gases could be more efficiently cooled. Accordingly, in order to do this, the baffle 38 is moved towards the right in the drawings of FIGS. 1 and 2 by operating a control lever in the cockpit which is linked to the sliding rods 42. As the baffle reaches the extreme position shown in dotted lines, it effectively blocks off most of the air passage 34 including the bypass formed by the recess 18, thereby diverting most of the air coming through the passage 34 into the secondary zone through the apertures 27 and 29. After takeoff, when the aircraft is under load conditions, the baffle 38 may be returned to its center position relative to the recess or bypass 18 allowing the air to pass unimpeded both to the primary zone and the secondary zone.

Figures 3, 4:
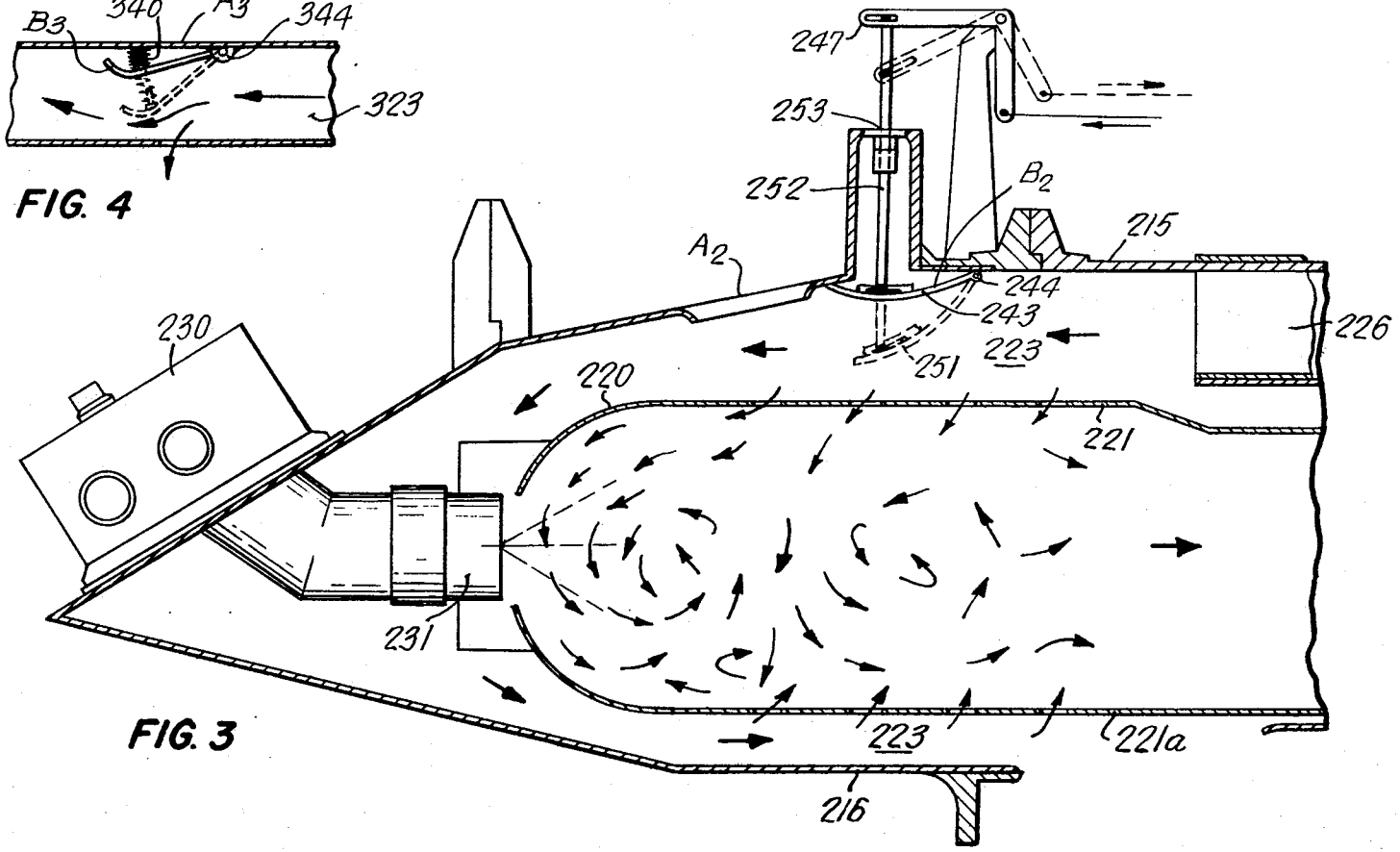
FIG. 3 is a fragmentary diagrammatic cross-section through a reverse-flow annular type of combustor, according to the invention.
FIG. 4 is a fragmentary diagrammatic cross-section through part of a combustor like that of FIG. 3, but showing an alternative form of baffle.

Referring now to the embodiment shown in FIG. 3, a combustion chamber 220, also of the annular reverse flow type, is illustrated. The casing A2 has an outside shell 215 and an inside shell 216 forming an annulus extending about the combustor and enclosing an annular combustion chamber having an outer wall 221 and an inner wall 221a. Fuel from a fuel control connection 230 is injected through a nozzle 231 into one end of the combustion chamber 220. There are several such nozzles spaced about the combustion chamber 220.

The outer and inner shells 215, 216 of the casing A2 form, with the combustion chamber 220, walls 221 and 221a, an annular passage 223. Air under compression enters through the annular tube 226 and passes from right to left in the drawing, through the annulus 223. The air passes, in a direction contra to the combustion stream, and about the nozzle end of the combustor as schematically shown by the arrows. It will be understood that there are a number of baffles B2 extending about the annulus between the combustor casing A2 and the combustor liner 221 so as to control the delivery air all about the annulus and control the proportion of air delivered to the primary and secondary zones through the holes (some of which have been shown) in the combustor liner. A series of control plates or baffles B2 are located about the annulus 223. By way of example, the baffle B2 is shown as having a plate 243 hinged as at 244 to the wall 215 connected by a bracket 251 to a control plunger 252 which operates in a guideway 253. The plunger 252 is connected to linkage indicated generally as 247, which, in turn, is connected to the throttle of the engine.

In operation, the baffles B2, when retained in the open position, shown in full lines in FIG. 3, allow free passage of air through the annulus 223 thus allowing a maximum amount of air to reach the primary zone 260 of the combustor near the fuel nozzle 231, as would be the case if no plate were present. When the control plate 243 is in a down position, as shown in dotted lines, air is diverted from the annulus 223 into the secondary zone 262 of the combustion chamber remote from the nozzle 231 while less air passes into the part of the passage surrounding the primary zone and thence into the primary zone of the combustion chamber. With the plates 243 in full open or full closed and intermediate positions, different adjustments of the amount of air passing into primary zone 260 and secondary zone 262 are possible.

By simply raising or lowering the plates 243, adjustment of the relative amount of air reaching respective primary and secondary zones is possible. Raising or lowering is achieved evenly by linking the plates 243 to the fuel throttle or by mechanically or electrically linking it with any other control of the gas turbine engine. Typically, when the engine is idling, the plates 243 will be in the down position. The primary zone will thus receive a fraction of the total air flow. The fuel-air ratio will be richer than usual. For cruising, the regulating device will be in a mid-position so as to give an average primary zone fraction of total air flow. During full power, the plates 243 will be in a retracted position for maximum primary zone fraction of total air flow.

At low fuel-air ratios, where emissions are the highest, reduction can be obtained by gradually increasing the blockage of the annular air passage. The parameters affecting the formation of carbon monoxide are known to be the same as those affecting the formation of hydrocarbons. Therefore, the carbon monoxide production will also be reduced at low power.

The combustor design of the invention has a leaner primary zone than a fixed geometry combustor, and reduced residence time in the primary zone at the high power end. Therefore, the maximum gas temperature will be lower. This design also incorporates early quenching in the intermediate zone; hence, the full load nitrogen oxides production will be reduced. At part load, the low inlet air temperature yields a lower maximum gas temperature and, hence, a low nitrogen oxide production.

FIG. 4 illustrates a modification of the design shown in FIG. 3. Similar numbers have been given to the parts except that they have been raised by one hundred over FIG. 3 and the lettered parts qualified by "3", for example, A3, B3. In this case, the baffle B3 is responsive to the pressure of incoming compressed air which, in turn, is proportional to power demand. The baffle B3 is normally in a down position shown in dotted lines in FIG. 4, diverting the air to the secondary zone. However, as the pressure of the compressed air increases in the passage 323, the baffle B3 is forced to pivot about pivot point 344 against the spring 346, thereby allowing more air to reach the primary zone.

Preferably, the hole pattern in the constructions shown in FIGS. 1 and 3 is designed to provide for minimum emission of oxides of nitrogen and early quenching of flame temperature in the primary zone, as discussed in more detail in connection with FIG. 1.

Figure 5:
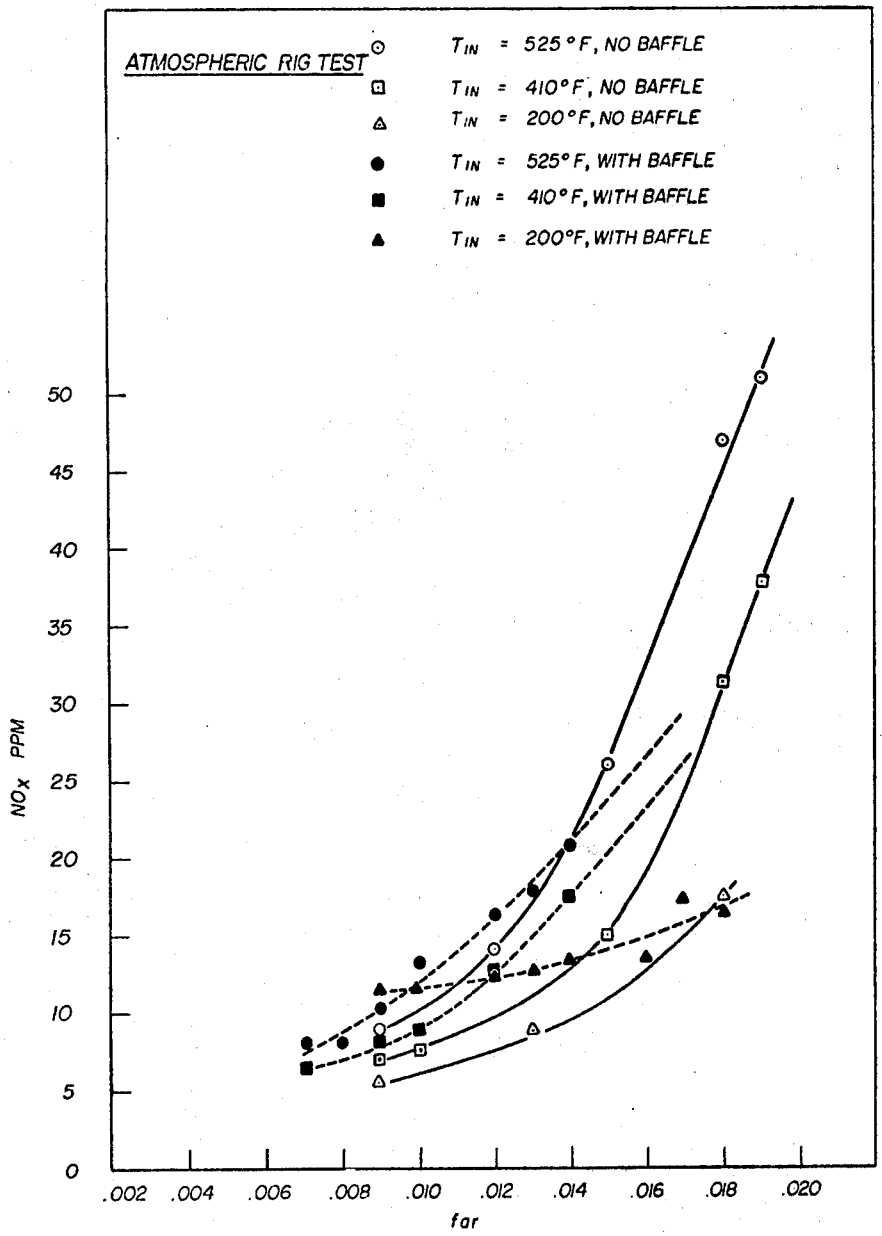
FIG. 5 is a graph showing the effect of a baffle control of air according to the invention, on nitric oxide emissions in the combustor of a typical aircraft engine.
Figure 6:
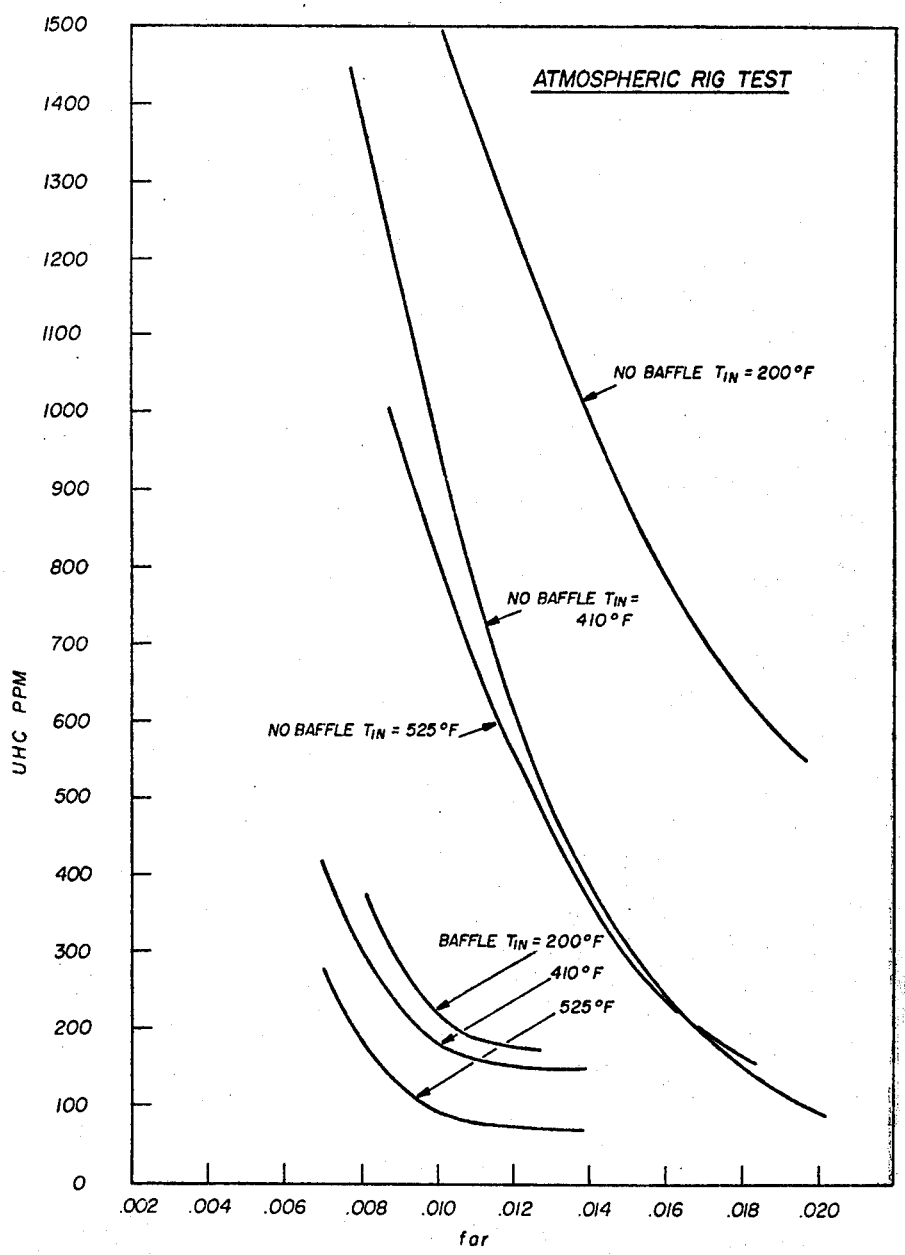
FIG. 6 is a graph showing the effect of the baffle control on unburned hydrocarbon emissions for the same combustor.
Figure 7:
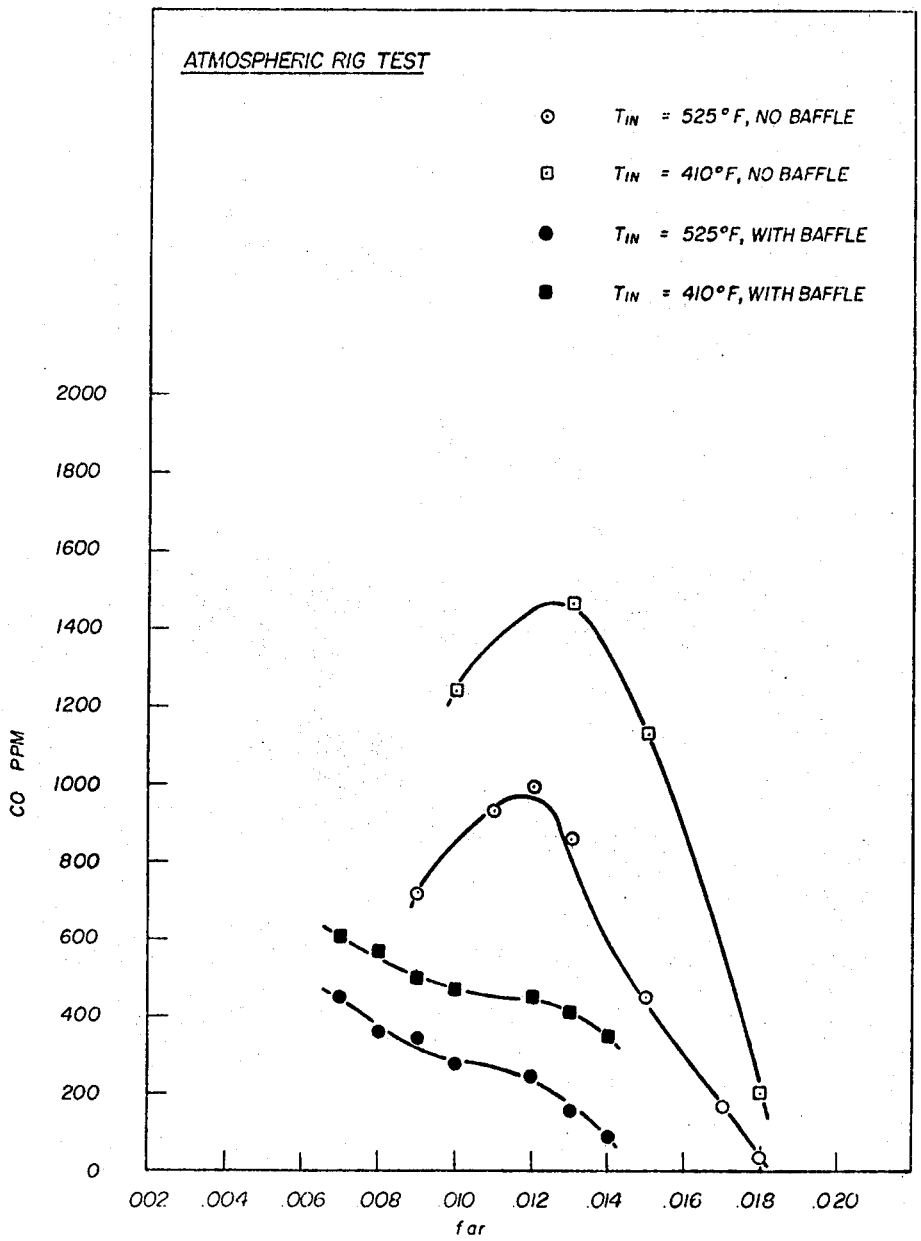
FIG. 7 is a graph showing the effect of the baffle control on carbon monoxide emissions for the same combustor.

The effects of the variable baffle on flow path are indicated on the graphs of atmospheric rig tests shown in FIGS. 5, 6 and 7. The curves show the significant effect of a variable geometry baffle on exhaust emissions of a typical combustor. The combustor used for these rig tests was that of the PT-6 gas turbine engine made by United Aircraft of Canada Limited. Large reductions in UHC and CO emissions result, with only marginal increases in $NO_x$ in the lower power range (where $NO_x$ emissions will not be a problem). There is also a crossover point on the $NO_x$ curves (FIG. 5) beyond which the baffle results in reductions of $NO_x$. Optimized designs of baffle and combustor are adapted to produce effective fuel-air ratio control for reduced emissions over the operating range of a given combustor.

These results are based on the use of a combustor having a conventional hole pattern, oriented towards efficient combustion. A hole pattern specifically designed for the reduction of oxides of nitrogen at the high power end would further reduce these emissions.

Typical types of combustor have been shown or mentioned by way of example. All configurations can employ a baffle in the air delivery passage to proportion the air between the primary and secondary combustion zones or may have a bypass arrangement with means for proportioning the air to the main passage and the bypass. An advantage of the latter type is that all the operating mechanism may be located in the bypass. For example, while the baffle plate 44 has been shown in FIG. 1 to control the entrance to the air delivery passage, the linkage may be connected to the baffle plate at a position within the bypass so as to remove it further from high temperature zones.

Advantages provided by the invention are as follows. Air distribution is proportioned throughout the entire combustion chamber and not isolated to discrete portions of it. Contrasting with the prior art, which is seeking to stay as close as possible to stoichiometric conditions for combustion efficiency, where the worst conditions for emissions of nitrogen is produced because of high temperatures created, the applicant's expedients compromise on combustion efficiency, at the maximum power, so as to reduce temperature and to reduce polluting emissions. At low power, these expedients improve combustion efficiency over conventional systems. The operating parts of the applicant's device are external to the combustor, completely detached from it and in a relatively cool compressor delivery air zone, thus not exposed to combustion temperature.

The materials from which the various parts of combustors, according to the invention, are made, as for example, appropriate heat-resistant alloys for the parts exposed to high temperatures, and their design will be well understood by one skilled in the art. It will also be understood that the specific combustors shown are merely by way of example and can be varied widely within the scope of the invention.

I claim:

1. In a continuous combustion device, a combustion chamber having a peripheral wall, means defining an air passage surrounding said combustion chamber, at least a fuel injector for feeding fuel into said combustion chamber, a primary combustion zone within said chamber defined around said fuel injector, at least a secondary combustion zone within said chamber defined adjacent said primary zone and downstream thereof, first air inlets in said peripheral wall in the area of said primary zone communicating with said air passage, second air inlets in said peripheral wall in the area of said secondary zone communicating with said air passage, a baffle provided in said air passage between the air inlets for said primary zone and the air inlets for said secondary zone, means for moving said baffle between a first position and a second position whereby in said first position air passes relatively unimpeded to both the primary zone and the secondary zone, and at the second position the baffle impedes the flow of air to said primary zone by deflecting a larger proportion of the air to the secondary combustion zone thereby modifying the characteristics and flow path of the primary zone and said secondary zone providing a richer fuel-/air mixture in the primary zone to thereby reduce the relative carbon monoxide and hydrocarbon emissions from said combustion chamber.

2. A continuous combustion device as defined in claim 1, wherein the baffle means is pivoted in the air passage between the primary zone and the secondary zone, and means are provided for pivoting the baffle between a position deflecting the air to the secondary combustion zone and a position allowing air to pass to the primary zone.

3. A continuous combustion device as defined in claim 2, wherein the pivotally mounted baffle is resiliently urged in a position diverting a larger proportion of air to the secondary combustion chamber through the second air inlets, and the baffle is moved to a position allowing more air to the primary zone in response to an increase in air pressure in the passage.

4. A combustion device as defined in claim 3, wherein the outer wall of the elongated combustion chamber is cylindrical and the fuel injection means is at one end thereof, and the air in the air passage moves from the opposite end of the cylindrical wall in a direction towards the fuel injection means.

5. A combustion device as defined in claim 4, wherein the combustion chamber is annular in shape, and the flow of air and gases within the chamber is in a direction reversed from the direction of the air in the air passage.

6. A combustion device as defined in claim 2, wherein the means for pivoting the baffle is a linkage directly to a manual control means.

7. A continuous combustion device as defined in claim 1, wherein the baffle is in the form of an annular ring and is adapted to slide longitudinally about the peripheral wall of the combustion chamber within the air passage between said first and second positions.

8. A continuous combustion device as defined in claim 7, wherein the air passage is enlarged in the area of the baffle so that when the slidable baffle is in the first position air can pass on both sides of the baffle, but when the baffle is in the second position, the baffle substantially blocks the enlarged area of the air passage.

9. A continuous combustion device as defined in claim 7, wherein the peripheral wall of the combustion chamber is cylindrical, and means defining the air passage with the outer wall is a concentric cylindrical casing, an enlarged annulus is provided in the area between the primary zone and the secondary zone, the baffle is a continuous annular member provided for longitudinal sliding movement in the annulus, and when the member is in the first position, it is central of the annulus allowing air to move substantially unimpeded to the primary zone, and when the member is in a second position, it abuts the casing and deflects air to the secondary zone substantially preventing the air from entering the annulus.

10. A continuous combustion device as defined in claim 9, wherein the combustion chamber is an annular type combustion chamber with the air and gases within the combustion chamber moving generally in a direction opposite to the air moving in the air passage.

11. A continuous combustion device as defined in claim 9, wherein the baffle has airfoil characteristics with an enlarged trailing tip converging in the trailing direction of the air flow so as to provide improved lamination of the air flow when the baffle is in said first position allowing the air to the primary zone.

* * * * *